United States Patent [19]

Niinomi

[11] 3,948,137

[45] Apr. 6, 1976

[54] PITCH DETERMINING VOLTAGE SIGNAL GENERATING CIRCUIT FOR A VOLTAGE CONTROLLED TYPE ELECTRONIC MUSICAL INSTRUMENT

[75] Inventor: Naoyuki Niinomi, Hamamatsu, Japan

[73] Assignee: Nippon Gakki Seizo Kabushiki Kaisha, Shizuoka, Japan

[22] Filed: Mar. 12, 1975

[21] Appl. No.: 557,524

[30] Foreign Application Priority Data

Mar. 15, 1974 Japan ..... 49-29796[U]

[52] U.S. Cl. ..... 84/1.01; 84/DIG. 2; 84/DIG. 8; 84/DIG. 20

[51] Int. Cl.[2] ..... G10H 1/00; G10H 5/02

[58] Field of Search ..... 84/1.01, 1.17, DIG. 2, 84/DIG. 7, DIG. 8, DIG. 9, DIG. 20, DIG. 23

[56] References Cited

UNITED STATES PATENTS

| | | | |
|---|---|---|---|
| 2,403,664 | 7/1946 | Langer | 84/DIG. 9 |
| 2,874,286 | 2/1959 | Bode | 84/DIG. 2 |
| 3,190,951 | 6/1965 | Anderson | 84/DIG. 23 |
| 3,417,188 | 12/1968 | Munch, Jr. | 84/1.01 |
| 3,733,955 | 5/1973 | Reinagel et al. | 84/1.01 |
| 3,745,225 | 7/1973 | Hall | 84/1.17 X |
| 3,766,305 | 10/1973 | Schrecongost | 84/1.01 |
| 3,786,166 | 1/1974 | Mieda | 84/1.01 |
| 3,813,474 | 5/1974 | Ippolito | 84/1.17 |
| 3,880,039 | 4/1975 | Studer | 84/1.01 |

*Primary Examiner*—L. T. Hix
*Assistant Examiner*—Stanley J. Witkowski
*Attorney, Agent, or Firm*—Flynn & Frishauf

[57] ABSTRACT

This invention is directed to a keyboard circuit for generating pitch determining voltage signals whose voltage values exponentially vary with respect to notes. Key switches are connected between a DC voltage source and a voltage dividing resistance network, thus making it possible to use key switches having a simpler contact construction. Nevertheless, the keyboard circuit of the invention can act as a lower or higher tone preference circuit.

7 Claims, 6 Drawing Figures

PITCH DETERMINING VOLTAGE SIGNAL GENERATING CIRCUIT FOR A VOLTAGE CONTROLLED TYPE ELECTRONIC MUSICAL INSTRUMENT

BACKGROUND OF THE INVENTION

This invention relates to a voltage controlled type electronic musical instrument using a voltage controlled type variable frequency oscillator as a tone generator, and more particularly to a keyboard circuit for generating a pitch determining voltage signal which is supplied to a voltage controlled oscillator.

Conventionally known is an electronic musical instrument utilizing a voltage controlled oscillator (hereinafter referred to as VCO) as a tone generator. The use of VCO contributes greatly to the simplification of a tone generating circuitry for a monophonic electronic musical instrument. Such an electronic musical instrument is usually constructed as shown in FIG. 1 so that a pitch determining voltage signal having a voltage corresponding to the note of a key operated on a keyboard is derived from a keyboard circuit 1 and then coupled to VCO 2. VCO 2 generates a tone signal having a tone pitch determined by the pitch determining voltage signal. The tone signal is fed to a tone coloring filter 3 where a desired tone color is imparted to the tone signal. The output signal of the tone coloring filter 3 is reproduced by a reproducing system not shown.

An electronic musical instrument as shown in FIG. 2 has also been developed. That is, a voltage controlled lowpass filter 12 (hereinafter referred to as VCF) and voltage controlled amplifier 13 (hereinafter referred to as VCA) are serially connected at the output side of VCO 11. VCO 11 generates a tone signal in response to the pitch determining voltage signal from a keyboard circuit 14 and the tone signal is then applied to VCF 12. VCF 12 is also coupled to the keyboard circuit 13 so that the cutoff frequency thereof varies in accordance with the voltage value of the pitch determining voltage signal.

The keyboard circuit 14 generates, in addition to the pitch determining voltage signal, a trigger signal resulting from the actuation of a key on the keyboard. The trigger signal is supplied to control waveform generators 15, 16 and 17. The respective control waveform generator is responsive to the trigger signal to produce a control waveform whose voltage value varies as a function of time. The output voltages of the control waveform generators 15, 16 and 17 are coupled to VCO 11, VCF 12 and VCA 13, respectively. The oscillation frequency of VCO 11, cutoff frequency of VCF 12 and gain of VCA 13 are transiently controlled in accordance with the waveforms of the control voltages, thereby providing particular sound effects. Parameter controlling voltage generators or potentiometers 18 which are manipulated by a player are provided for controlling various parameters of control waveforms from the control waveform generators 15, 16 and 17 so as to vary the waveforms. By so doing, sound effects can be freely controlled by the intention of the player.

The output of VCA 13 is supplied to a reproducing system including a power amplifier 19 and a loudspeaker 20.

Where VCO as shown in FIGS. 1 and 2 is used, it is required that the voltage values of the pitch determining voltage signals from the keyboard circuit exponentially vary in the order of the tone pitch in case of the equally tempered musical scale. Since in the equally tempered musical scale the frequency ratio of adjacent two tones is $2^{1/12}$, it is required to generate voltage signals in accordance with the frequency relation of the equally tempered musical scale. That is, the voltage ratio of the pitch determining voltage signals corresponding to adjacent two keys on the keyboard is required to be $2^{1/12}$.

FIG. 3 shows a prior art keyboard circuit for such a use. In this figure, single-pole double-throw key switches $S_1$, $S_2$, $S_3$, . . . $S_{n-1}$ and $S_n$ are serially connected, in the sequence of the tone pitch, with respect to their normally closed fixed contacts and movable contacts. The normally open fixed contacts of the key switches $S_1$, $S_2$, . . . $S_{n-1}$ and $S_n$ are each connected to a junction or voltage dividing point of a plurality of equally valued resistors RO serially connected across a DC voltage source E. The pitch determining voltage signal is derived from the movable contact of the key switch $S_n$ situated on the extreme right-hand side of the key switch arrangement i.e. driven by the highest note key on the keyboard. That is, the key switch arrangement of FIG. 3 is of a higher tone preference type. With this arrangement, however, the voltage of the pitch determining voltage signal varies merely in a linear fashion with respect to the notes of the keys. Consequently, it is necessary to provide an exponential amplifier 30 at the output of the key switch $S_n$ to convert the linear voltage variation into the exponential voltage variation.

Since with the arrangement of FIG. 3 the pitch determining voltage signal is derived through the series-connected key switches, it is necessary to use highly reliable key switches. Otherwise, drawbacks of key switch contacts, for example, contact resistance are accumulated to affect the voltage level of a pitch determining voltage signal. One-pole double-throw key switch is unpreferable in the reliability due to its complicated construction.

FIG. 4 shows another prior art keyboard circuit arrangement. Key switches $S_1$, $S_2$, . . . $S_{n-1}$ and $S_n$ having the same contact structure as those shown in FIG. 3 are connected in like manner. In a voltage dividing network, a plurality of first resistors r having an equal value are connected in series with each other, and the series connection of the first resistors *r* has one end, i.e. highest tone side, connected to a DC source E and the other end, i.e. lowest tone side, grounded through a second resistor $R_1$. A plurality of third resistors R having an equal value are connected between corresponding junctions between the series-connected adjacent two first resistors *r* and ground. Each dividing point is connected to a normally open fixed contact of the corresponding key switch.

If the following relations are established between the resistors *r*, $R_1$ and R, pitch determining voltage signals exponentially varied with respect to notes as shown in FIG. 6 are obtained from the output terminal O without using an exponential amplifier.

$$\frac{r}{R_1} = 2^{\frac{1}{12}} - 1, \text{ and}$$

$$\frac{r}{R} = 2^{\frac{1}{12}} + 2^{-\frac{1}{12}} - 2$$

The features of the keyboard circuit as shown in FIG. 4 reside in that the voltage dividing network is connected directly to the DC voltage source and that upon the key actuation the pitch determining voltage signal is derived through one or more series-connected key switches from the voltage dividing point. The reason why the key switches having the complicated contact structure are used in the arrangement shown in FIG. 4 is to assure deriving from the output terminal a pitch determining voltage signal perfectly corresponding to the highest or lowest note of actuated keys.

SUMMARY OF THE IVENTION

It is accordingly the object of this invention to provide a keyboard circuit of a voltage controlled type electronic musical instrument which is capable of generating, in accordance with the equally tempered musical scale, pitch determining voltage signals whose voltage values are exponentially varied with respect to notes without using an exponential amplifier and key switches having a complicated contact structure.

According to this invention a keyboard circuit including a DC voltage source, a plurality of key switches, a plurality of first resistors having an equal value, a second resistor and a plurality of third resistors having an equal value, is so arranged that the first resistors are connected in series with each other, one end of the series connection of the first resistors is connected to the output of the keyboard circuit, the output of the keyboard circuit is connected through the second resistor to a reference potential point, a plurality of junctions between the series-connected two adjacent first resistors are connected through the third resistors to the reference potential point, and the plurality of key switches are each connected between the DC voltage source and each of junctions between the series-connected two adjacent first resistors and both ends of the series connection of the first resistors.

In order to generate in accordance with the equally tempered musical scale pitch determining voltage signals exponentially varied with respect to notes, the resistive values of the first, second and third resistors $r$, $R_1$ and R are selected to have the following relations:

$$\frac{r}{R_1} = 2^{\frac{1}{12}} - 1, \text{ and}$$

$$\frac{r}{R} = 2^{\frac{1}{12}} + 2^{-\frac{1}{12}} - 2.$$

Since according to the keyboard circuit of this invention the DC voltage source is separated from the voltage dividing network and connected, through a corresponding key switch, to a respective junction between the series-connected two adjacent first resistors, even if one or more first resistors are shunted upon the simultaneous actuation of a plurality of keys, it is possible to assuredly generate at the output terminal a pitch determining voltage signal having a magnitude corresponding to the highest or lowest note of actuated keys. This permits the use of key switches having a simpler construction.

DESCRIPTION OF THE PREFERRED EMBODIMENT

Figure 1:
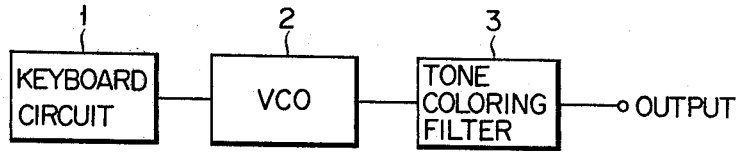
FIG. 1 PRIOR ART
FIG. 1 is a block diagram of a prior art voltage controlled type electronic musical instrument.
Figure 2:
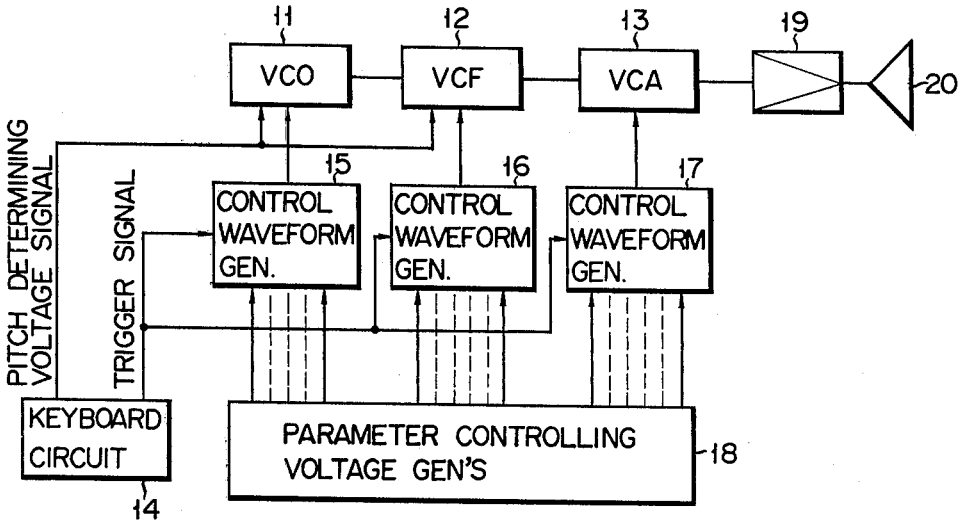
FIG. 2 PRIOR ART
FIG. 2 is a block diagram of another prior art voltage controlled type electronic musical instrument.
Figure 3:
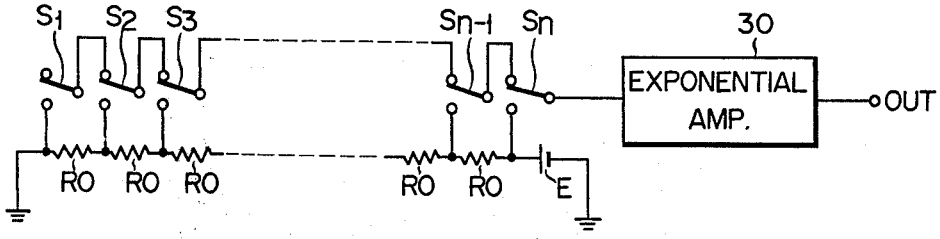
FIG. 3 PRIOR ART
FIG. 3 shows a circuit arrangement of a prior art keyboard circuit.
Figure 4:
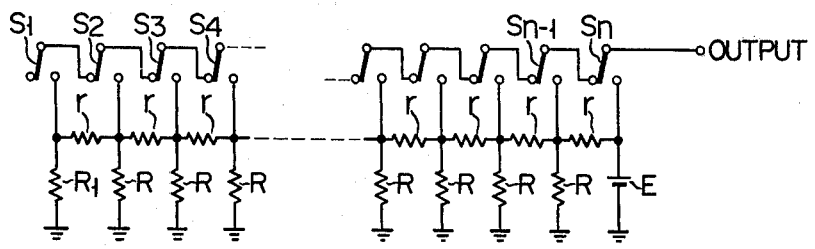
FIG. 4 PRIOR ART
FIG. 4 shows a circuit arrangement of another prior art keyboard circuit.
Figure 5:
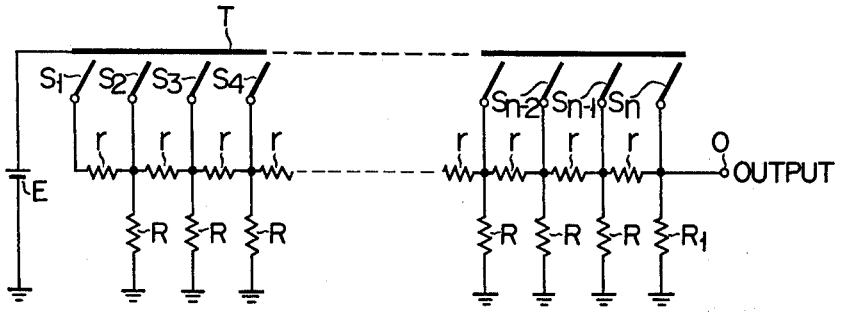
FIG. 5 shows a circuit arrangement of a keyboard circuit according to one embodiment of this invention.
Figure 6:
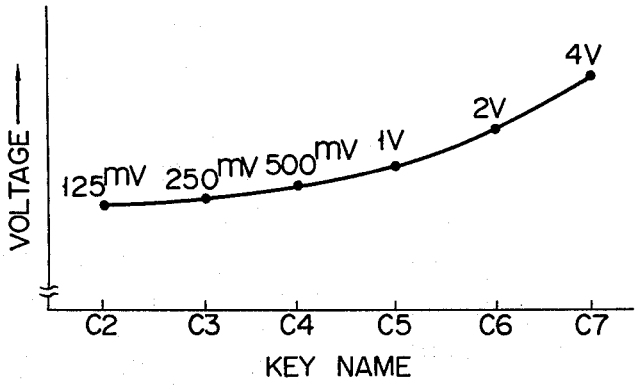
FIG. 6 is a graphical representation showing with respect to a key name the output voltage characteristic of the keyboard circuit of FIGS. 4 and 5.

Referring to FIG. 5 there is shown a keyboard circuit according to one embodiment of this invention. As shown in this Figure, a plurality of first resistors $r$ — which are, for example $n-1$ in number if $n$ number of keys are used —are connected in series, and the series connection of the first resistors has one end connected to an output terminal O of the keyboard circuit. The output terminal O is grounded through a second resistor $R_1$. Each junction between the two adjacent resistors $r$ is grounded through each of a plurality of third resistors R each having an equal value. The other end of the series connection of first resistors $r$, junctions between two series connected first resistors and output terminal O are connected to the movable contacts of key switches $S_1, S_2, \ldots S_{n-1}$ and $S_n$, respectively, which are actuated by the corresponding keys. A DC voltage source E (e.g. 4 volts) is connected between ground and a common fixed terminal T of the key switches $S_1$ to $S_n$. Switches $S_1$ to $S_n$ could be for example, single pole single throw switches.

In FIG. 5 the switches $S_1$ and $S_n$ arranged in the extreme left and right positions, respectively, of the keyboard circuit are actuated by keys corresponding to the lowest and highest notes, for example $C_2$ and $C_7$, respectively, within a compass of the keyboard. Therefore, it will be noted that the keyboard circuit of FIG. 5 is so constructed as to function as a higher tone preference circuit.

There will now be explained a relation between the first, second and third resistors necessary for generating pitch determining voltage signals whose voltage values are sequentially varied at the ratio of $2^{1/12}$.

With reference to FIG. 5, it will be noted that output voltages $V_1$, $V_2$ and $V_3$ appearing at the output terminal O when the key switches $S_n$, $S_{n-1}$ and $S_{n-2}$ are separately actuated are represented as follows:

$$V_1 = E \tag{1}$$

$$V_2 = \frac{R_1}{R_1 + r} E \tag{2}$$

$$V_3 = \left( \frac{1}{\frac{1}{R} + \frac{1}{r + R_1}} \cdot \frac{R_1}{r + R_1} / r + \frac{1}{\frac{1}{R} + \frac{1}{r + R_1}} \right) E \tag{3}$$

When the equally tempered musical scale is taken into consideration, the following relations should be established:

$$V_2 \times 2^{\frac{1}{12}} = V_1 \quad (4)$$

$$V_3 \times 2^{\frac{1}{12}} = V_2 \quad (5)$$

From the equations (4) and (5), the following relations are obtained.

$$\frac{r}{R_1} = 2^{\frac{1}{12}} - \approx 0.0594630 - - - \approx \frac{1}{16.81715} \quad (6)$$

$$\frac{r}{R} = 2^{\frac{1}{12}} + 2^{-\frac{1}{12}} - 2 \approx 0.00333740 - - - \approx \frac{1}{299.6338} \approx \frac{1}{300} \quad (7)$$

Therefore, if the resistive values of the first, second and third resistors are selected to satisfy the above relations, it is possible to obtain output voltages whose levels are sequentially varied at the ratio of $2^{1/12}$.

It is undesirable, however, to use resistors whose values are either too great or too small. Where the resistive value is too small, electric current flows through the contact of the key switch, leading to an expedited wear of the contact and generation of sparks. Where, on the other hand, the resistive value is too great, a time constant with an input capacitance of a succeeding stage circuit will not be negligible, so that the corresponding voltage value i.e. tone pitch will likely deviate from a predetermined value.

An example of the preferred numerical value of each resistor is as follows.

$r = 100$ ohms $R_1 = 1.681$ kiloohms, and $R = 30$ kiloohms

Now consider output voltages when a plurality of keys are simultaneously actuated. If, for example, the key switches $S_{n-2}$ and $S_{n-1}$ are simultaneously actuated, it will be understood that one first resistor r connected between the movable contacts of the key switches $S_{n-2}$ and $S_{n-1}$ will be shunted. However, the DC voltage source E coupled to the dividing network through $S_{n-2}$ and $S_{n-1}$ is divided by the extreme right hand side first resistor $r$ and the second resistor $R_1$. Accordingly, the output voltage value appearing at the output terminal O when the key switches $S_{n-2}$ and $S_{n-1}$ are simultaneously actuated is identical with an output voltage value obtained when the key switch $S_{n-1}$ is solely actuated. In spite of the use of the key switches having such a simpler contact construction as shown in FIG. 5, the keyboard circuit according to this invention, even when a plurality of key switches are simultaneously actuated, can produce at the output terminal of the keyboard circuit a voltage the same as an output voltage obtained when a key corresponding to the highest note of actuated keys is solely actuated. That is, the keyboard circuit of this invention can completely perform the higher tone preference function. It is needless to say that a lower tone preference type keyboard circuit can be constructed. In this case, in FIG. 5 the output terminal O and second resistor $R_1$ are connected to the movable contact of the key switch $S_1$. Though in FIG. 5 the key switches $S_1$ to $S_n$ are shown as having a common fixed terminal T, they may be constructed as having a separate individual fixed terminal.

What is claimed is:

1. In an electronic musical instrument comprising a keyboard circuit for producing at an output thereof a pitch determining voltage signal having a voltage representing the note of an actuated key, and a voltage controlled oscillator coupled to said keyboard circuit and responsive to the pitch determining voltage signal from the output of said keyboard circuit to generate a tone signal having a tone pitch which is a function of the pitch determining voltage signal, said keyboard circuit comprising:

a DC voltage source;

a voltage dividing network including a plurality of first resistors which are series connected and have a substantially equal resistance value, one end of the series-connection of said first resistors being connected to said output of said keyboard circuit, a second resistor connecting said output of said keyboard circuit to a reference potential point, and a plurality of third resistors connecting respective junctions between two adjacent series-connected first resistors to the reference potential point, said third resistors each having a substantially equal resistance value; and a plurality of key switches respectively connected between said DC voltage source and (i) each of said junctions and (ii) both ends of said series connection of said first resistors.

2. An electronic musical instrument according to claim 1 wherein the resistance values of said first, second and third resistors $r$, $R_1$ and R have substantially the following relationships:

$$\frac{r}{R_1} = 2^{\frac{1}{12}} - 1, \text{ and}$$

$$\frac{r}{R} = 2^{\frac{1}{12}} + 2^{-\frac{1}{12}} - 2.$$

3. An electronic musical instrument according to claim 1 wherein said key switches have a common terminal connected to said DC voltage source.

4. An electronic musical instrument according to claim 1 wherein each of said key switches is a single pole, single throw switch.

5. An electronic musical instrument according to claim 1 wherein said reference potential is at the same voltage level as one terminal of said DC voltage source.

6. An electronic musical instrument according to claim 5 wherein said reference potential is ground potential.

7. An electronic musical instrument according to claim 1 wherein said reference potential is ground potential.

* * * * *